US007868772B2

(12) United States Patent
Chao et al.

(10) Patent No.: US 7,868,772 B2
(45) Date of Patent: Jan. 11, 2011

(54) FLAME DETECTING METHOD AND DEVICE

(75) Inventors: Hao-Ting Chao, Taichung County (TW); Chung-Hsien Lu, Hsinchu County (TW); Yu-Ren Hsu, Kaohsiung County (TW); Shen-Kuen Chang, Chiayi (TW); Yi Chih Chen, Taipei (TW); Kun-Lin Huang, Hsinchu (TW); Cheng-Wei Wang, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 294 days.

(21) Appl. No.: 12/081,078

(22) Filed: Apr. 10, 2008

(65) Prior Publication Data

US 2008/0191886 A1 Aug. 14, 2008

Related U.S. Application Data

(63) Continuation-in-part of application No. 11/760,661, filed on Jun. 8, 2007, now abandoned.

(30) Foreign Application Priority Data

Dec. 12, 2006 (TW) ..... 95146545 A
Dec. 11, 2007 (TW) ..... 96147304 A

(51) Int. Cl.
*G08B 17/12* (2006.01)

(52) U.S. Cl. ..... 340/578; 340/636.11; 340/601; 340/573.6

(58) Field of Classification Search ..... 340/578, 340/577, 573.7, 573.6, 579, 587, 588, 589, 340/600–601, 629, 636.11
See application file for complete search history.

(56) References Cited

U.S. PATENT DOCUMENTS 6,184,792 B1 * 2/2001 Privalov et al. ..... 340/578

(Continued)

FOREIGN PATENT DOCUMENTS

AU 2004202851 A1 1/2005

(Continued)

OTHER PUBLICATIONS

Töreyin et al., "Computer vision based method for real-time fire and flame detection", Pattern Recognition Letters. p. 1-10, 2005.

(Continued)

*Primary Examiner*—Daniel Previl
(74) *Attorney, Agent, or Firm*—Birch, Stewart, Kolasch & Birch, LLP

(57) ABSTRACT

A flame detecting method and device are provided to improve the accuracy of flame detection and reduce the possibilities of the false fire alarm. The flame detecting method and device capture a plurality of images of a monitored area; determines whether a moving area image exists in the plurality of images; analyzes at least one of a color model and a flickering frequency of the moving area image to generate a first analyzed result and compares the first analyzed result with a feature of a reference flame image; analyzes at least one of a variation of a location and an area of the moving area image to generate a second analyzed result and compares the second analyzed result with a predetermined threshold; and determines whether the moving area image is a flame image based on results of the comparing steps.

38 Claims, 4 Drawing Sheets

U.S. PATENT DOCUMENTS

| | | | | |
|---|---|---|---|---|
| 6,937,743 | B2 * | 8/2005 | Rizzotti et al. | 382/100 |
| 6,956,485 | B1 * | 10/2005 | Aird et al. | 340/577 |
| 7,155,029 | B2 * | 12/2006 | King et al. | 382/100 |
| 2005/0253728 | A1 * | 11/2005 | Chen et al. | 340/577 |
| 2006/0215904 | A1 | 9/2006 | Ibrahim et al. | |

FOREIGN PATENT DOCUMENTS

| | | | |
|---|---|---|---|
| CN | 1576839 | A | 2/2005 |
| CN | 1852428 | A | 10/2006 |
| CN | 1943824 | A | 4/2007 |
| JP | 04-286097 | | 10/1992 |
| JP | 11-144167 | | 5/1999 |
| JP | 2000-331262 | | 11/2000 |
| JP | 2002-279545 | | 9/2002 |
| JP | 2006-190307 | | 7/2006 |
| JP | 2006-331416 | | 12/2006 |

OTHER PUBLICATIONS

Permuter, Haim, et al. "A study of Gaussian mixture models of color and texture features for image classification and segmentation," Pattern Recognition: The Journal of the Pattern Recognition Society, vol. 39, pp. 695-706, XP025226930, 2006.

* cited by examiner

FLAME DETECTING METHOD AND DEVICE

CROSS-REFERENCE TO RELATED APPLICATIONS

This application is a Continuation-In-Part of application Ser. No. 11/760,661 filed on Jun. 8, 2007 now abandoned, and for which priority is claimed under 35 U.S.C. §120; and this application claims priority of Application No. 95146545 filed in Taiwan on Dec. 12, 2006 under 35 U.S.C. §119; the entire contents of all are hereby incorporated by reference.

FIELD OF THE INVENTION

The present invention relates to a flame detecting method and device, and more particular to a flame detecting method and device using the image analyzing techniques.

BACKGROUND OF THE INVENTION

Since the scales of the offices and factories are bigger and bigger, the height thereof is higher and higher, the structures thereof are more and more peculiar and the facilities thereof are more and more complicated, the conventional fire fighting facilities may not work effectively in those situations. If the conventional monitoring system can be improved to capture and analyze images and to determine if there is flame in a building through a particular algorithm, the fire might be detected and controlled efficiently and immediately at its early stage.

The image determining method is to recognize the flame through various steps in an algorithm. The first step is to capture the images through the monitoring system. Then the motilities and the color models of the objects in the images are analyzed by the calculating processors, such as the computers and the digital signal processor (DSP). The conventional recognizing methods such as the background subtraction method, the statistical method, the temporal differencing method and the optical flow method are to separate the pixels whose pixel property difference exceeds a threshold value of the images and compare these pixels to a flame color model. If the conditions of the objects in the images meet the flame features, those objects might be identified as flame. These conventional recognizing methods use the RGB color model as a comparing basis. However, the color recognition accuracy of the RGB color model is not good enough. Therefore, the objects with a similar color to the flame are identified as having the flame properties.

Moreover, the conventional recognizing methods only use the motion detection and the color model recognition, which easily result in misrecognition and cause incorrect identification. For example, if a man dressed in red walks through the monitored area, he will be identified as a moving object with the red element of the flame features and determined as the flame, thereby triggering a false alarm.

U.S. Pat. Nos. 6,184,792 and 6,956,485 disclose some algorithms to detect early fire in a monitored area. U.S. Pat. No. 6,184,792 discloses a method and an apparatus for detecting early fire in a monitored area, which analyzes a brightness variation for video images by performing a Fast Fourier Transform (FFT) on the temporally varying pixel intensities. U.S. Pat. No. 6,956,485 discloses a flame detection algorithm to analyze a frequency variation by a filter-analyzing technology. However, the accuracy of these detecting methods is not mentioned in these patents, and other analyzing techniques, e.g. a chrominance variation analyzing, are not applied in these patents.

SUMMARY OF THE INVENTION

In order to overcome the drawbacks in the prior art, a flame detecting method and device are provided. Not only does the present invention solve the problems described above, but also it is easy to be implemented. Thus, the present invention has the utility for the industry.

One aspect of the present invention is to provide a flame detecting method and a device thereof to monitor and determine if a flame exists in order to actuate an alarm and put out the flame in time. Furthermore, the flame detecting method and the device thereof improve the accuracy of flame detection and reduce the possibilities of the false alarm.

In accordance with one aspect of the present invention, a flame detecting method is provided. The flame detecting method includes: capturing a plurality of images of a monitored area; determining whether a moving area image exists in the plurality of images;

analyzing a color model of the moving area image to generate a first analyzed result and comparing the first analyzed result with a first feature of a reference flame image, wherein the color model applies at least one of a three-dimensional RGB Gaussian mixture model and a three-dimensional YUV Gaussian mixture model; and determining whether the moving area image is a flame image based on results of the comparing step.

In accordance with another aspect of the present invention, a flame detecting method is provided. The flame detecting method includes: capturing a plurality of images of a monitored area; determining whether a moving area image exists in the plurality of images;

analyzing a flickering frequency of the moving area image to generate a first analyzed result; and determining whether the moving area image is a flame image based on the first analyzed result.

In accordance with still another aspect of the present invention, a flame detecting method is provided. The flame detecting method includes: capturing a plurality of images of a monitored area; analyzing a location of a moving area image in the plurality of images to generate a first analyzed result; determining whether the moving area image is a flame image based on the first analyzed result.

In accordance with still another aspect of the present invention, a flame detecting method is provided. The flame detecting method includes: capturing a plurality of images of a monitored area; analyzing an area of a moving area image in the plurality of images to generate a first analyzed result; and determining whether the moving area image is a flame image based on the first analyzed result.

In accordance with still another aspect of the present invention, a flame detecting device is provided. The flame detecting device includes: an image capturing unit capturing a plurality of images; a first analyzing unit analyzing a color model of a moving area image in the plurality of images to generate a first analyzed result, wherein the color model applies at least one of a three-dimensional RGB Gaussian mixture model and a three-dimensional YUV Gaussian mixture model; and a comparing unit comparing the first analyzed result to a reference flame feature.

In accordance with still another aspect of the present invention, a flame detecting device is provided. The flame detecting device includes: an image capturing unit capturing a plurality of images; a first analyzing unit analyzing a flickering frequency of a moving area image in the plurality of images to generate a first analyzed result; and a comparing unit comparing the first analyzed result to a reference flame feature.

In accordance with still another aspect of the present invention, a flame detecting device is provided. The flame detecting device includes: an image capturing unit capturing a plurality of images; a location analysis unit analyzing a location variation of the moving area image to generate a first analyzed result; and a comparing unit coupled to the area analysis and comparing the first analyzed result with a first predetermined threshold.

In accordance with still another aspect of the present invention, a flame detecting device is provided. The flame detecting device includes: an image capturing unit capturing a plurality of images; an area analysis unit coupled to the image capturing unit for analyzing an area variation of the moving area image to generate a first analyzed result; and a comparing unit coupled to the area analysis and comparing the first analyzed result with a first predetermined threshold.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE ILLUSTRATED EMBODIMENTS

Figure 1:
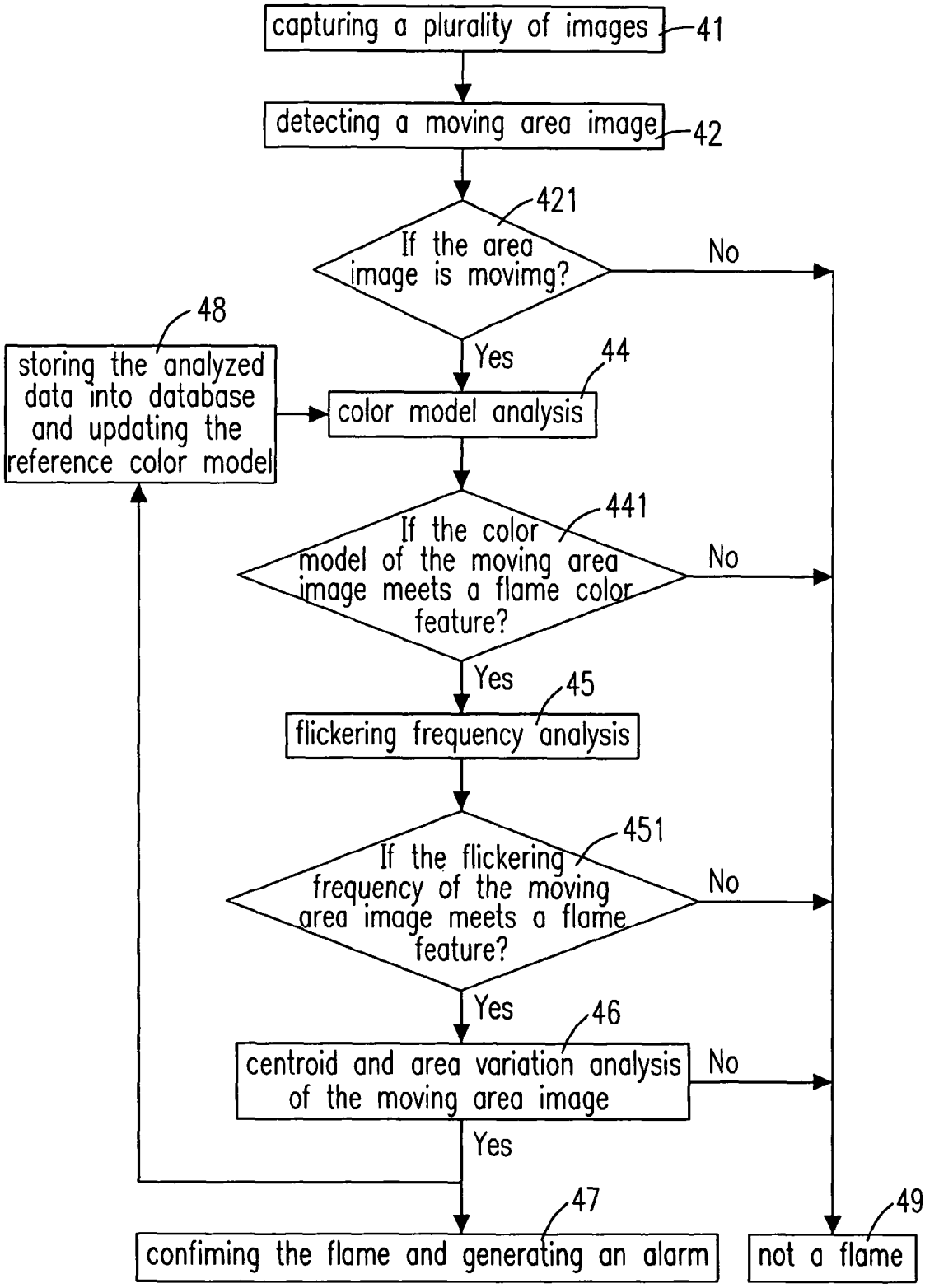
FIG. 1 illustrates a flow chart of the flame detecting method in an embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

To overcome the problems of the false alarm and the delay of putting out the flame due to the incorrect identification of the conventional detecting method, a flame detecting method and a device thereof are provided.

FIG. 1 shows a flow chart of the flame detecting method in an embodiment of the present invention. First, a plurality of images are captured (step 41), wherein the plurality of images are recorded images of a monitored area at different time. For example, a first image is taken in a first capture time and a second image is taken in a second capture time. Then, the motion detection is performed (step 42) to analyze if a moving area image exists in the plurality of images (step 421). The moving area image is a specific image covering an area which has different images in the first image and in the second image. The moving area image is also referred to as a moving object in the monitored area in a time interval between the first capture time and the second capture time.

If a moving area image does not exist, the process goes to step 49 which represents that no flame is detected. If a moving area image exists, the process proceeds to step 44 for a color model analysis. The color model analysis analyzes the color model of the moving area image and determines if it meets a reference flame color feature (step 441). If yes, the process proceeds to step 45 for a flickering frequency analysis; if not, the process goes to step 49. In step 45, the flickering frequency analysis analyzes the flickering frequency of the moving area image, and determines if it meets a flame flickering feature (step 451). If yes, the process proceeds to step 46 for a centroid and area variation analysis, if not, the process goes to step 49. There are two analyses in step 46, one of which is a location analysis of the moving area image and the other one of which is an area analysis of the moving area image. They are respectively performed to check whether a variation of the centroid location of the moving area image or a variation the area/size of the moving area image is lower than the predetermined values. If yes, the process proceeds to the steps 47 and 48; if not, the process goes to step 49. Step 47 is to confirm the flame and generate an alarm signal, and step 48 is to store the above analyzed data into a database for updating.

In the step 44, the color model analysis comprises a three-dimensional Gaussian mixture model (GMM) analysis with three parameters, which include a color pixels variation of the moving area image, a time and a space. Furthermore, a three dimensional RGB Gaussian mixture model can be adopted to determine whether the moving area image has a feature of a RGB Gaussian distribution probability in a reference flame color feature. A three dimensional YUV Gaussian mixture model can also be adopted to determine whether the moving area image has a feature of a YUV Gaussian distribution probability in a reference flame color feature. Moreover, the color model analysis further comprises an Artificial Neural Network (ANN) analysis, which is trained by four color parameters R, G, B, and I. A Back-Propagation network (BPN) model can also be used in the Artificial Neural Network analysis, which can be set up with 2 hidden layers and 5 nodes per layer. The analyzed results of the moving area image are then compared to the features of a reference flame in the database.

The above-mentioned YUV model is color model which is different from the commonly used RGB (Red-Green-Blue) model, wherein the color parameter Y stands for "Luminance", the color parameter U stands for "Chrominance" and the color parameter V stands for "Chroma". The relationship between the YUV model and RGB model is:

$$Y=0.299*R+0.587*G+0.114*B$$

$$U=0.436*(B-Y)/(1-0.114)$$

$$V=0.615*(R-Y)/(1-0.299)$$

The above-mentioned color parameter I is known as "Intensity" or "gray value", and the relationship between the parameter I and the parameters R, G, and B is I=(R+G+B)/3.

The use of the Gaussian mixture model (GMM) analysis and Artificial Neural Network analysis (ANN) can highly increase the accuracy in the color analysis of a flame.

In step 45, the flickering frequency analysis is performed with a one-dimensional Time Wavelet Transform (TWT) to analyze how at least one of a color and a height of the moving area image vary with time. In an embodiment, the color parameter Y or I is analyzed in the one-dimensional Time Wavelet Transform (TWT), and a range of the flickering frequency for the at least one color parameter from 5 Hz to 10 Hz is adopted for analyzing. A satisfied result can be obtained by simply performing the Time Wavelet Transform analysis once, which significantly reduces the calculation time.

The analyzed results of the moving area image are then compared to the flickering features of the reference flame features in the database. The use of the Time Wavelet Transform in the flickering frequency analysis has the advantages of keeping the time relationship in the analyzed result. Moreover, the calculation becomes simpler and faster by using a one-dimensional Time Wavelet Transform.

In step 46, the centroid location and the area of the moving area image varying with time are analyzed, because, according to the characteristic of a flame, the location and area thereof should not change with a large scale in a very short time.

In the centroid location variation analysis of step 46, an object tracking algorithm is adopted to analyze and determine the extent that the centroid location of the moving area image varies with time. If the extent the variation of the centroid location of the moving area image exceeds a first predetermined range, the moving area image can be determined as not a flame image.

The first predetermined range can be set as:

$$|(X_{t+1}, Y_{t+1})-(X_t, Y_t)|<TH1,$$

wherein $(X_t, Y_t)$ is the centroid location of the moving area image in the first capture time, $(X_{t+1}, Y_{t+1})$ is the centroid location of the moving area image in the second capture time, and TH1 is a predetermined value. In an embodiment, TH1 can be set as about 80 pixels when the image size of the images is about 320×240 pixels.

In the area variation analysis of step 46, an object tracking algorithm is adopted to analyze and determine another extent the area of the moving area image varies with time. If the extent the variation of the area of the moving area image with time exceeds a second predetermined range, the moving area image can be determined as not a flame image.

In an embodiment, the second predetermined range can be set as:

$$(1/3)A_t<A_{t+1}<3A_t,$$

wherein $A_t$ is the area of the moving area image in the first capture time, and $A_{t+1}$ is the area of the moving area image in the second capture time.

Through the steps of above-mentioned, the accuracy of the flame detection can be highly improved so that the false alarm would not happen.

In an embodiment, the step 46 is carried out when the analyzed results of the step 44 and the step 45 have been already determined, and the step 47 is carried out when all of the analyzed results obtained from the steps 44-46. However, to increase the efficiency and reduce the complexity of the flame detecting method, the steps 44-46 can be randomly and optionally carried out without a specific sequence.

Figure 2A:
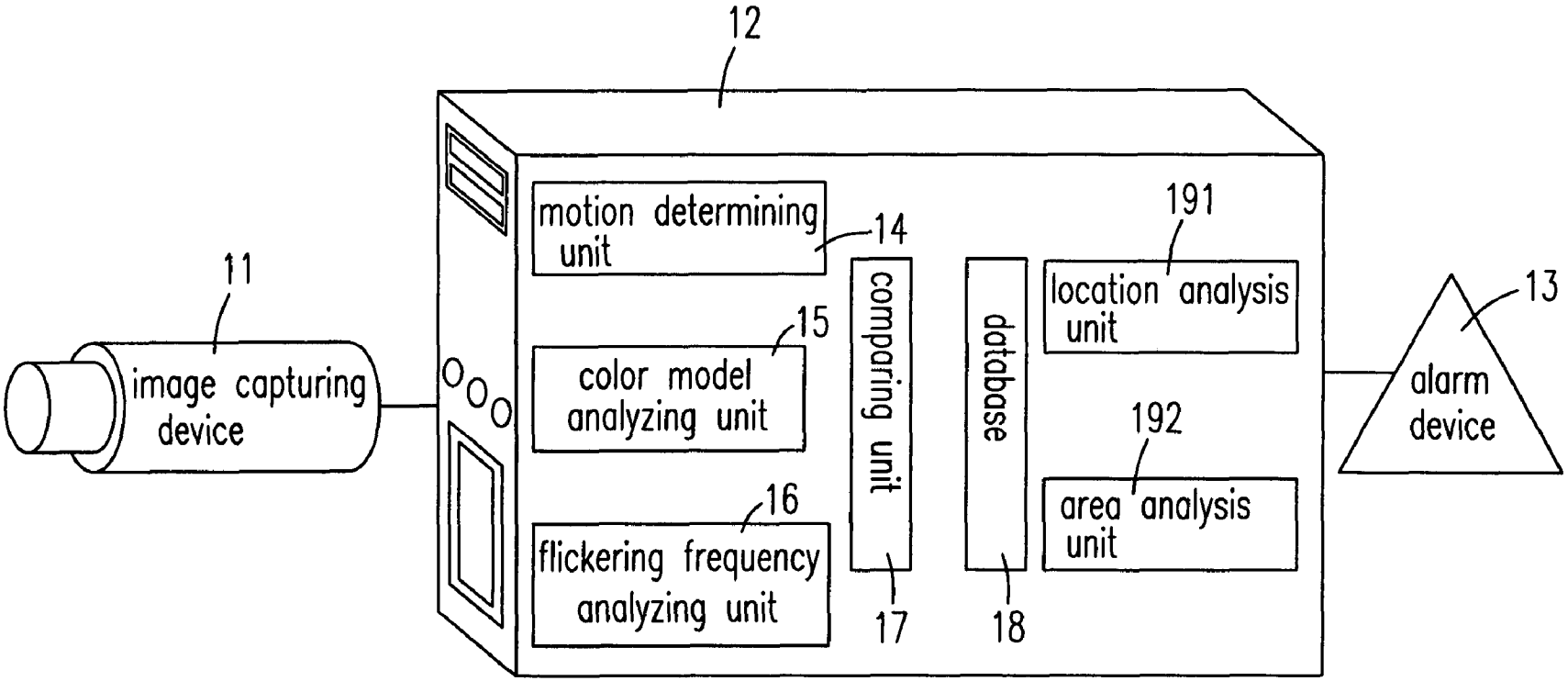
FIG. 2A illustrates a structure of the flame detecting device according to a first embodiment of the present invention.

FIG. 2A illustrates the structure of the flame detecting device according to a first embodiment of the present invention. The flame detecting device includes an image capturing device 11, a computer 12 and an alarm device 13. The computer 12 has a motion determining unit 14, a color model analyzing unit 15, a flickering frequency analyzing unit 16, a comparing unit 17, a database 18, a location analysis unit 191 and an area analysis unit 192. The database 18 stores abundant flame features obtained from experiments and previous analyses including the Gaussian color model and the flickering frequency data.

The flame detecting device captures a plurality of images through the image capturing device 11. Whether a moving area image exists in the plurality of images is determined by using the updating background motion determining method of the motion determining unit 14. The colors of the moving area image are analyzed by the color model analyzing unit 15. The flickering frequency relating to the color and height variations of the moving area image with time is analyzed by the flickering frequency analyzing unit 16. The comparing unit 17 is configured to compare the analyzed data with the reference flame features data in the database 18 so as to determine if the moving area image has the same color model and flickering frequency as those of a reference flame. Then, the location analysis unit 191 and the area analysis unit 192 are configured to check if the variations of the centroid location and the area of the moving area image with time are too large so that the moving object represented by the moving area image is impossible to be a flame.

If the color and flickering features of the moving area image match the reference flame features and the variations of the centroid location and the area of the moving area image with time are smaller than the predetermined ranges, the computer 12 determines the moving area image as a flame image and generates an alarm signal through the alarm device 13. The alarm device 13 is configured to send the alarm signal to any of the central controlling computer of the fire monitoring center, the flame signal receiver or a mobile phone.

However, for increasing the efficiency and reduce the complexity of the flame detecting device, any one of the units of the color model analyzing unit 15, the flickering frequency analyzing unit 16, the location analysis unit 191, and the area analysis unit 192 can be randomly and optionally adopted in the computer 12.

Figure 2B:
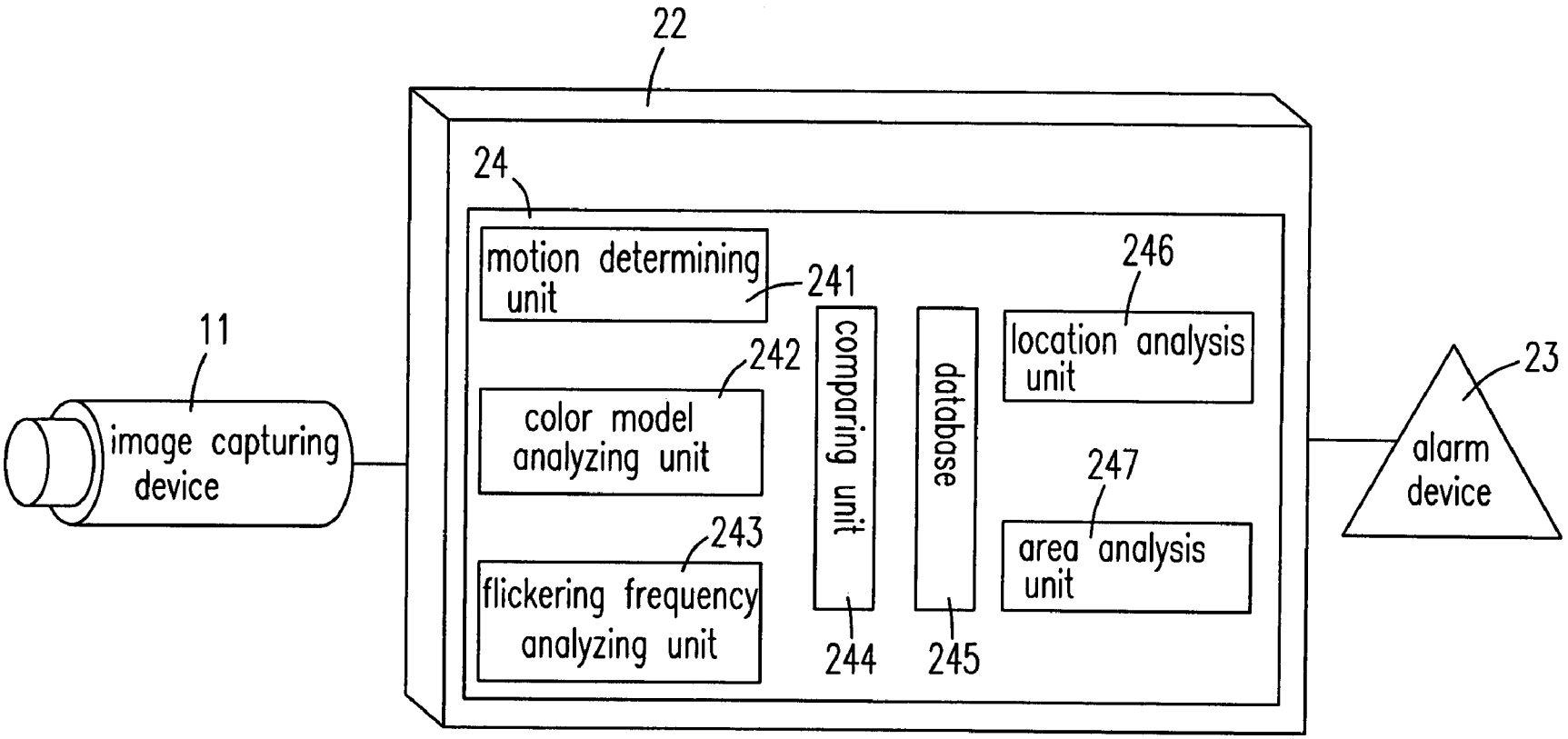
FIG. 2B illustrates a structure of the flame detecting device according to a second embodiment of the present invention.

FIG. 2B illustrates the structure of the flame detecting device according to a second embodiment of the present invention. The flame detecting device includes an image capturing device 21, a digital video recorder 22 and an alarm device 23. The digital video recorder 22 comprises a digital signal processor 24, which contains a motion determining unit 241, a color model analyzing unit 242, a flickering frequency analyzing unit 243, a comparing unit 244 and a database 245, a location analysis unit 246 and an area analysis unit 247. The database 245 stores abundant flame features obtained from experiments and previous analyses including the Gaussian color model and the flickering frequency data.

The flame detecting device captures a plurality of images through the image capturing device 21. Whether a moving area image exists in the plurality of images is determined by using the updating background motion determining method of the motion determining unit 241. The color of the moving area image is analyzed by the color model analyzing unit 242. The flickering frequencies relating to the color and the height variations of the moving area image varied with time are analyzed by the flickering frequency analyzing unit 243. Then, the comparing unit 245 is configured to compare the analyzed data to the reference flame features data in the database 246 to determine if the moving area image has the same color model and flickering frequency features as those of the reference flame image. Then, the location analysis unit 246 and the area analysis unit 247 are configured to check if the variations of the centroid location and the area of the moving area image with time are too large so that the moving object represented by the moving area image is impossible to be a flame.

If the color and flickering features of the moving area image match the reference flame features and the variations of the centroid location and the area of the moving area image varying with time are smaller than the predetermined ranges, the flame detecting device 22 determines the moving area image as a flame image and generates an alarm signal through the alarm device 23. The alarm device 23 is configured to send the alarm signal to any of the central controlling computer of the fire monitoring center, a flame signal receiver or a mobile phone.

However, for increasing the efficiency and reduce the complexity of the flame detecting device, any one of the units of the color model analyzing unit 242, the flickering frequency analyzing unit 243, the location analysis unit 246, and the area analysis unit 247 can be randomly and optionally adopted in the digital signal processor 24.

Figure 2C:
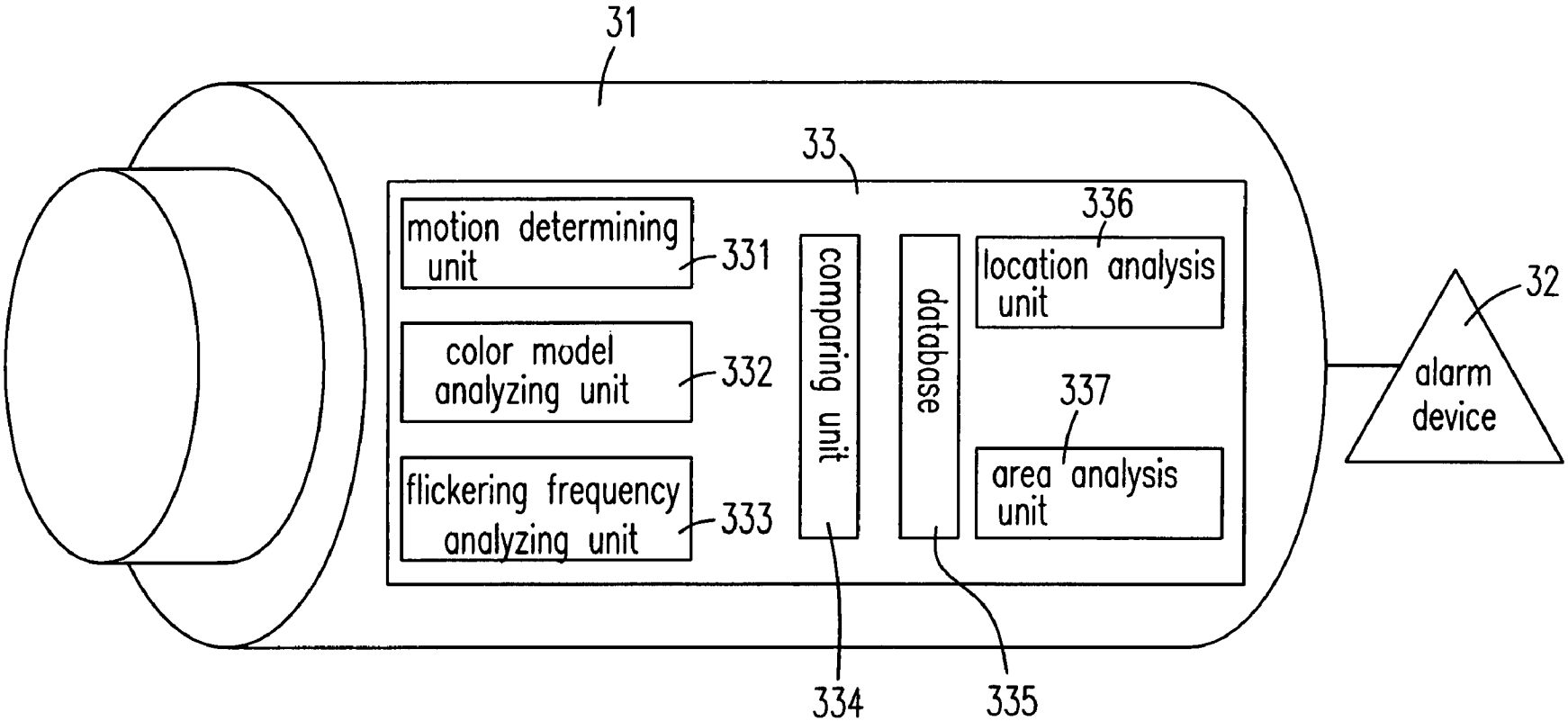
FIG. 2C illustrates a structure of the flame detecting device according to a third embodiment of the present invention.

FIG. 2C illustrates the structure of the flame detecting device according to a third embodiment of the present invention. The flame detecting device includes an image capturing device 31 and an alarm device 32. The image capturing device 31 comprises a digital signal processor 33 having a motion determining unit 331, a color model analyzing unit 332, a flickering frequency analyzing unit 333, a comparing unit 334, a database 335, a location analysis unit 336 and an area analysis unit 337. The database 335 stores abundant flame features obtained from experiments and previous analyses including the Gaussian color model and the flickering frequency data.

The flame detecting device captures a plurality of images through the image capturing device 31. Whether a moving area image exists in the plurality of images is determined by using the updating background motion determining method of the motion determining unit 331. The color of the moving area image is analyzed by the color model analyzing unit 332. The flickering frequencies relating to how the variations of the color and the height of the moving area image with time are analyzed by the flickering frequency analyzing unit 333. The comparing unit 334 is configured to compare the analyzed data to the flame features data in the database 335 to determine if the moving area image has the same color model and flickering frequency features as those of the reference flame image. Then, the location analysis unit 336 and the area analysis unit 337 are configured to check if the variations of the centroid location and the area of the moving area image with time are too large so that the moving object represented by the moving area image is impossible to be a flame.

If the color and flickering features of the moving area image match the reference flame features and the variations of the centroid location and the area of the moving area image with time are smaller than the predetermined ranges, the flame detecting device 31 determines the moving area image as a flame image and generates an alarm signal through the alarm device 32. The alarm device 32 is configured to send the alarm signal to any of the central controlling computer of the fire monitoring center, a flame signal receiver and a mobile phone.

However, for increasing the efficiency and reduce the complexity of the flame detecting device, any one of the units of the color model analyzing unit 332, the flickering frequency analyzing unit 333, the location analysis unit 336, and the area analysis unit 337 can be randomly and optionally adopted in the digital signal processor 33.

The database 18, 245 and 335 in the illustrated flame detecting devices store lots of the flame features data which are analyzed from a lot of fire documentary films. In these flame features data in the database, the color model is obtained from analyzing the flame image data by the Gaussian mixture model (GMM) which is a three-dimensional analysis model and used for analyzing the flame color pixels varying degree with time and space. The flickering frequency is obtained from a one-dimensional Time Wavelet Transform (TWT) which analyzes the flame color and the flame height varying degree with time. Subsequently, the analyzed data are processed to be the statistical data and stored in the database for comparison. Besides, the database 18, 245, 335 can learn and update by themselves, so that once the flame detecting device detects a real flame, the database 18, 245, 335 will add the detected data thereinto and update the color model and the flickering frequency data so as to make the subsequent analysis more precise.

The color model analyzing units 15, 242 and 332 are respectively coupled to the motion determining units 14, 241 and 331, and are executed with a Gaussian mixture model and a three-dimensional analysis with three parameters, which are a color pixel variation of the moving area image, a time, and a space. Furthermore, a three-dimensional RGB Gaussian mixture model can be adopted to determine whether the moving area image has a feature of a RGB Gaussian distribution probability in a flame color feature. In addition, a three-dimensional YUV Gaussian mixture model can also be adopted to determine whether the moving area image has a feature of at least one of a RGB Gaussian distribution probability and a YUV Gaussian distribution probability in a flame color feature.

Moreover, the color model analyzing units 15, 242 and 332 can be executed with an Artificial Neural Network (ANN) and/or a Back-Propagation network (BPN) model. The color parameters, R, G, B and I can be adopted for the neural network training, and the Back-Propagation network (BPN) model can be set up with 2 hidden layers and 5 nodes per layer.

The flickering analyzing units 16, 243 and 333 are respectively coupled to the image capturing unit and analyzes how at least one of a color and a height of the moving area image varies with time by using a Time Wavelet Transform, and a range of a flickering frequency for the at least one color parameter from 5 Hz to 10 Hz is adopted for analyzing. Preferably, a One-dimensional Time Wavelet Transform can be adopted for faster and simpler calculation. A satisfied result can be obtained by simply performing the Time Wavelet Transform analysis once, which significantly reduces the calculation time.

The location analysis units 191, 246 and 336 are respectively coupled to the image capturing units to determine an extent that a centroid location of the moving area image varies with time by using an object tracking algorithm. If the extent that a centroid location of the moving area image varies with time exceeds the first predetermined value, the moving area image is determined as not a flame image, since the centroid location of a flame image should not change with a large scale in a very short time.

In an embodiment, the first predetermined range can be set as:

$$|(X_{t+1}, Y_{t+1})-(X_t, Y_t)|<TH1,$$

wherein $(X_t, Y_t)$ is the centroid location of the moving area image in a first capture time, $(X_{t+1}, Y_{t+1})$ is the centroid location of the moving area image in a second capture time and TH1 is a predetermined value, for example, TH1 can be set as about 80 pixels while the plurality of images have a size of 320×240 pixels.

The area analysis units 192, 247 and 337 are respectively coupled to the image capturing units to determine another extent that an area of the moving area image varies with time by using an object tracking algorithm. If the extent that the area of the moving area image varies with time exceeds a second predetermined value, the moving area image is determined as not a flame image since the area of a flame image should not change with a large scale in a very short time.

In an embodiment, the first predetermined range can be set as:

$$(1/3)A_t<A_{t+1}<3A_t,$$

wherein $A_t$ is the area of the moving area image in the first capture time, and $A_{t+1}$ is the area of the moving area image in the second capture time.

According to the configuration of the location analysis units and the area analysis units, a flame can be detected more precisely by the devices with fewer false alarms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flame detecting method, comprising steps of:

capturing a plurality of images of a monitored area, wherein the plurality of images are recorded images of the monitored area at different time and comprise a first image in a first capture time and a second image in a second capture time;

determining whether a moving area image exists in the plurality of images;

analyzing a color model of the moving area image to generate a first analyzed result and comparing the first analyzed result with a first feature of a reference flame image, wherein the color model applies at least one of a three-dimensional RGB Gaussian mixture model and a three-dimensional YUV Gaussian mixture model;

analyzing a location of the moving area image to generate a third analyzed result and comparing the third analyzed result with a first predetermined threshold, wherein the analyzing and comparing steps comprise steps of:

analyzing and determining a first extent a centroid location of the moving area image varies with time by using an object tracking algorithm; and determining the moving area image is not a flame image when the first extent exceeds a first predetermined range, which is defined as:

$$\|(Xt+1, Yt+1)-(Xt, Yt)|<TH1,$$

wherein (Xt,Yt) is the centroid location of the moving area image in the first capture time, (Xt+1,Yt+1) is the centroid location of the moving area image in the second capture time, and TH1 is a predetermined value; and determining whether the moving area image is a flame image based on results of the comparing step.

2. The flame detecting device as claimed in claim 1, wherein the moving area image is a specific image being different in the first space image and in the second space image and represents a moving object in the monitored area in a time interval between the first capture time and the second space time.

3. The flame detecting method as claimed in claim 2, further comprising:

analyzing a flickering frequency of the moving area image to generate a second analyzed result and comparing the second analyzed result with a second feature of a reference flame image;

analyzing an area of the moving area image to generate a fourth analyzed result and comparing the fourth analyzed result with a second predetermined threshold;

storing the first and second analyzed results into a data base; and sending out an alarm signal when the moving area image is determined as a flame image.

4. The flame detecting method as claimed in claim 3, wherein the step of analyzing the flickering frequency determines how at least one of a color and a height of the moving area image varies with time by using a one-dimensional Time Wavelet Transform, wherein at least one of color parameters I and Y is analyzed, and a range of a flickering frequency for the at least one of the color parameters I and Y from 5 Hz to 10 Hz is adopted for analyzing.

5. The flame detecting method as claimed in claim 3, wherein the step of analyzing the variation of the area of the moving area image includes:

determining a second extent an area of the moving area image varies with time by using an object tracking algorithm; and determining the moving area image is not a flame image when the second extent exceeds a second predetermined range, which is defined as:

$$(1/3)At<At+1<3At,$$

wherein At is the area of the moving area image in the first capture time, and At+1 is the area of the moving area image in the second capture time.

6. The flame detecting method as claimed in claim 1, wherein TH1 is 80 pixels when the size of the plurality of images is 320×240 pixels.

7. The flame detecting method as claimed in claim 1, wherein the step of analyzing the color model includes:

applying a three-dimensional analysis with three parameters, which include an area color pixels variation of the moving area image, a time and a space;

determining whether the moving area image has a feature of a RGB Gaussian distribution probability of a flame color feature and/or whether the moving area image has a feature of a YUV Gaussian distribution probability of a flame color feature;

applying an artificial neural network analysis, which is trained by four color parameters, R, G, B, and I; and applying a Back-Propagation network (BPN) model comprising two hidden layers in the artificial neural network analysis, wherein each hidden layer has 5 nodes.

8. A flame detecting method, comprising steps of:

capturing a plurality of images of a monitored area, wherein the plurality of images are recorded images of the monitored area at different time and comprise a first image in a first capture time and a second image in a second capture time;

determining whether a moving area image exists in the plurality of images;

analyzing a flickering frequency of the moving area image to generate a first analyzed result;

analyzing an area of the moving area image to generate a fourth analyzed result and comparing the fourth analyzed result with a second predetermined threshold, wherein the analyzing and the comparing step comprise the steps of:

determining a second extent an area of the moving area image varies with time by using an object tracking algorithm; and determining the moving area image is not a flame image when the second extent exceeds a second predetermined range, which is defined as:

$$(1/3)At<At+1<3At,$$

wherein At is the area of the moving area image in the first capture time, and At+1 is the area of the moving area image in the second capture time; and determining whether the moving area image is a flame image based on the first analyzed result.

9. The flame detecting method as claimed in claim 8, further comprising:

comparing the first analyzed result with a first feature of a reference flame image;

analyzing a color model of the moving area image to generate a second analyzed result and comparing the second analyzed result with a second feature of a reference flame image, wherein the color model applies at least one of a three-dimensional RGB Gaussian mixture model and a three-dimensional YUV Gaussian mixture model;

analyzing a location of the moving area image to generate a third analyzed result and comparing the third analyzed result with a first predetermined threshold;

determining whether the moving area image is a flame image based on results of the comparing steps;

storing the first and second analyzed results into a data base; and sending out an alarm signal when the moving area image is determined as a flame image.

10. The flame detecting method as claimed in claim 8, wherein the step of analyzing the flickering frequency determines how at least one of a color and a height of the moving area image varies with time by using a one-dimensional Time Wavelet Transform, wherein at least one of color parameters I and Y is analyzed, and a range of a flickering frequency for the at least one of the color parameters I and Y from 5 Hz to 10 Hz is adopted for analyzing.

11. A flame detecting method, comprising steps of:

capturing a plurality of images of a monitored area, wherein the plurality of images are recorded images of the monitored area at different time and comprise a first image in a first capture time and a second image in a second capture time;

analyzing a location of a moving area image in the plurality of images to generate a first analyzed result;

analyzing and determining a first extent a centroid location of the moving area image varies with time by using an object tracking algorithm; and determining the moving area image is not a flame image when the first extent exceeds a first predetermined range, which is defined as:

$$|(Xt+1, Yt+1)-(Xt, Yt)|<TH1,$$

wherein (Xt,Yt) is the centroid location of the moving area image in the first capture time, (Xt+1,Yt+1) is the centroid location of the moving area image in the second capture time, and TH1 is a predetermined value.

12. The flame detecting method as claimed in claim 11, wherein the moving area image is a specific image being different in the first space image and in the second space image and represents an moving object in the monitored area in a time interval between the first capture time and the second capture time.

13. The flame detecting method as claimed in claim 12, further comprising:

determining whether the moving area image exists in the plurality of images;

comparing the first analyzed result with a first predetermined threshold;

analyzing a color model of the moving area image to generate a second analyzed result and comparing the second analyzed result with a second feature of a reference flame image, wherein the color model applies at least one of a three-dimensional RGB Gaussian mixture model and a three-dimensional YUV Gaussian mixture model;

analyzing a flickering frequency of the moving area image to generate a third analyzed result and comparing the second analyzed result with a third feature of a reference flame image;

analyzing an area of the moving area image to generate a fourth analyzed result and comparing the fourth analyzed result with a second predetermined threshold;

determining whether the moving area image is a flame image based on results of the comparing step;

determining whether the moving area image is a flame image based on results of the comparing steps;

storing the second and third analyzed results into a data base; and sending out an alarm signal when the moving area image is determined as a flame image.

14. The flame detecting method as claimed in claim 13, wherein the step of analyzing the color model includes:

applying a three-dimensional analysis with three parameters, which include an area color pixels variation of the moving area image, a time and a space;

determining whether the moving area image has a feature of a RGB Gaussian distribution probability of a flame color feature and/or whether the moving area image has a feature of a YUV Gaussian distribution probability of a flame color feature;

applying an artificial neural network analysis, which is trained by four color parameters, R, G, B, and I; and applying a Back-Propagation network (BPN) model comprising two hidden layers in the artificial neural network analysis, wherein each hidden layer has 5 nodes.

15. The flame detecting method as claimed in claim 13, wherein the step of analyzing the flickering frequency determines how at least one of a color and a height of the moving area image varies with time by using a one-dimensional Time Wavelet Transform, wherein at least one of color parameters I and Y is analyzed, and a range of a flickering frequency for the at least one of the color parameters I and Y from 5 Hz to 10 Hz is adopted for analyzing.

16. The flame detecting method as claimed in claim 13, wherein the step of analyzing the variation of the area of the moving area image includes:

determining a second extent an area of the moving area image varies with time by using an object tracking algorithm; and determining the moving area image is not a flame image when the second extent exceeds a second predetermined range, which is defined as:

$$(1/3)At<At+1<3At,$$

wherein At is the area of the moving area image in the first capture time, and At+1 is the area of the moving area image in the second capture time.

17. The flame detecting method as claimed in claim 11, wherein TH1 is 80 pixels when the size of the plurality of images is 320×240 pixels.

18. A flame detecting method, comprising steps of:

capturing a plurality of images of a monitored area, wherein the plurality of images are recorded images of the monitored area at different time and comprise a first image in a first capture time and a second image in a second capture time;

analyzing an area of a moving area image in the plurality of images to generate a first analyzed result;

determining a second extent an area of the moving area image varies with time by using an object tracking algorithm; and determining the moving area image is not a flame image when the second extent exceeds a second predetermined range, which is defined as:

$$(1/3)At<At+1<3At,$$

wherein At is the area of the moving area image in the first capture time, and At+1 is the area of the moving area image in the second capture time.

19. The flame detecting method as claimed in claim 18, further comprising:

determining whether the moving area image exists in the plurality of images;

comparing the first analyzed result with a first predetermined threshold;

analyzing a color model of the moving area image to generate a second analyzed result and comparing the second analyzed result with a second feature of a reference flame image, wherein the color model applies at least one of a three-dimensional RGB Gaussian mixture model and a three-dimensional YUV Gaussian mixture model;

analyzing a flickering frequency of the moving area image to generate a third analyzed result and comparing the second analyzed result with a third feature of a reference flame image;

analyzing a location of the moving area image to generate a fourth analyzed result and comparing the fourth analyzed result with a second predetermined threshold;

determining whether the moving area image is a flame image based on results of the comparing steps;

storing the second and third analyzed results into a data base; and sending out an alarm signal when the moving area image is determined as a flame image.

20. A flame detecting device, comprising:

an image capturing unit capturing a plurality of images, wherein the plurality of images are recorded images of the monitored area at different time and comprise a first image in a first capture time and a second image in a second capture time;

a first analyzing unit analyzing a color model of a moving area image in the plurality of images to generate a first analyzed result, wherein the color model applies at least one of a three-dimensional RGB Gaussian mixture model and a three-dimensional YUV Gaussian mixture model;

an area analysis unit coupled to the image capturing unit for analyzing an area variation of the moving area image to generate a fourth analyzed result, which is compared with a second predetermined threshold, wherein the area analysis unit determines a second extent an area of the moving area image varies with time by using an object tracking algorithm, and the moving area image is determined as not a flame image when the second extent exceeds a second predetermined range, which is defined as:

$$(1/3)At<At+1<3At$$

wherein At is an area of the moving area image in the first capture time, and At+1 is an area of the moving area image in the second capture time; and a comparing unit comparing the first analyzed result to a reference flame feature.

21. The flame detecting device as claimed in claim 20, wherein the moving area image is a specific image being different in the first space image and in the second space image and represents a moving object in the monitored area in a time interval between the first capture time and the second space capture time.

22. The flame detecting device as claimed in claim 21, further comprising:

a second analyzing unit coupled to the image capturing unit and determining whether the moving area image exists in the plurality of images;

a third analyzing unit coupled to the image capturing unit and analyzing a flickering frequency of the moving area image to generate a second analyzed result, which is compared with a flickering frequency feature of a reference flame;

a location analysis unit coupled to the image capturing unit and analyzing a location variation of the moving area image to generate a third analyzed result, which is compared with a first predetermined threshold;

a database coupled to the comparing unit and storing the reference flame feature; and an alarming unit coupled to the comparing unit for generating an alarm signal when the moving area image is determined as a flame image, wherein the comparing unit is coupled to each of the analyzing units.

23. The flame detecting device as claimed in claim 22, wherein the second analyzing unit analyzes how at least one of a color and a height of the moving area image varies with time by using a one-dimensional Time Wavelet Transform, wherein at least one of color parameters I and Y is analyzed, and a range of a flickering frequency for the at least one of the color parameters I and Y from 5 Hz to 10 Hz is adopted for analyzing.

24. The flame detecting device as claimed in claim 22, wherein the location analysis unit determines a first extent a centroid location of the moving area image varies with time by using an object tracking algorithm, and the moving area image is determined as not a flame image when the first extent exceeds a first predetermined range, which is defined as:

$$|(Xt+1, Yt+1)-(Xt, Yt)|<TH1,$$

wherein (Xt,Yt) is the centroid location of the moving area image in the first capture time, (Xt+1,Yt+1) is the centroid location of the moving area image in the second capture time, and TH1 is a predetermined value.

25. The flame detecting method as claimed in claim 24, wherein TH1 is 80 pixels when a size of the plurality of images is 320×240 pixels.

26. The flame detecting device as claimed in claim 22, wherein the database further stores the first and third analyzed results when the moving area image is determined as a flame for serving as a second reference flame feature.

27. The flame detecting device as claimed in claim 20, wherein the first analyzing unit is coupled to the image capturing unit and determines whether the moving area image has a feature of at least one of an RGB Gaussian distribution probability and a YUV Gaussian distribution probability of a flame color feature, and applies a Gaussian mixture model and a three-dimensional analysis with three parameters, and the three parameters are a color pixels variation of the moving area image, a time and a space.

28. The flame detecting device as claimed in claim 20, wherein:

the first analyzing unit is configured with an artificial neural network analysis, which is trained by four color parameters, R, G, B, and I; and a Back-Propagation network (BPN) model comprising two hidden layers is adopted in the artificial neural network analysis, wherein each hidden layer has 5 nodes.

29. The flame detecting device as claimed in claim 20, wherein the image capturing unit is one of a camera and a video recorder.

30. A flame detecting device, comprising:

an image capturing unit capturing a plurality of images, wherein the plurality of images are recorded images of the monitored area at different time and comprise a first image in a first capture time and a second image in a second capture time;

a first analyzing unit analyzing a flickering frequency of a moving area image in the plurality of images to generate a first analyzed result;

a location analysis unit coupled to the image capturing unit and analyzing a location variation of the moving area image to generate a third analyzed result, which is compared with a first predetermined threshold, wherein the location analysis unit determines a first extent a centroid location of the moving area image varies with time by using an object tracking algorithm, and the moving area image is determined as not a flame image when the first extent exceeds a first predetermined range, which is defined as:

$$|(Xt+1, Yt+1)-(Xt, Yt)|<TH1,$$

wherein (Xt,Yt) is the centroid location of the moving area image in the first capture time, (Xt+1,Yt+1) is the centroid location of the moving area image in the second capture time, and TH1 is a predetermined value; and a comparing unit comparing the first analyzed result to a reference flame feature.

31. The flame detecting device as claimed in claim 30, wherein the flame detecting device further comprises:

a second analyzing unit coupled to the image capturing unit and determining whether the moving area image exists in the plurality of images;

a third analyzing unit coupled to the image capturing unit and analyzing a color model of a moving area image in the plurality of images to generate a second analyzed result which is compared to a color model feature of a reference flame, wherein the color model applies at least one of a three-dimensional RGB Gaussian mixture model and a three-dimensional YUV Gaussian mixture model;

an area analysis unit coupled to the image capturing unit for analyzing an area variation of the moving area image to generate a fourth analyzed result, which is compared with a second predetermined threshold;

a database coupled to the comparing unit and storing the reference flame feature; and an alarming unit coupled to the comparing unit for generating an alarm signal when the moving area image is determined as a flame image, wherein the comparing unit is coupled to each of the analyzing units.

32. The flame detecting device as claimed in claim 31, wherein the third analyzing unit determines whether the moving area image has a feature of at least one of a RGB Gaussian distribution probability and a YUV Gaussian distribution probability of a flame color feature, and adopts a Gaussian mixture model and a three-dimensional analysis with three parameters, and the three parameters are a color pixels variation of the moving area image, a time and a space.

33. The flame detecting device as claimed in claim 30, wherein the first analyzing unit is coupled to the image capturing unit and analyzes how at least one of a color and a height of the moving area image varies with time by using a one-dimensional Time Wavelet Transform, wherein at least one of color parameters I and Y is analyzed, and a range of a flickering frequency for at least one of the color parameters I and Y from 5 Hz to 10 Hz is adopted for analyzing.

34. A flame detecting device, comprising:

an image capturing unit capturing a plurality of images, wherein the plurality of images are recorded images of the monitored area at different time and comprise a first image in a first capture time and a second image in a second capture time;

a location analysis unit analyzing a location variation of the moving area image to generate a first analyzed result, wherein the location analysis unit determines a first extent a centroid location of the moving area image varies with time by using an object tracking algorithm, and the moving area image is determined as not a flame image when the first extent exceeds a predetermined range, which is defined as:

$$|(Xt+1, Yt+1)-(Xt, Yt)|<TH1,$$

wherein (Xt,Yt) is the centroid location of the moving area image in the first capture time, (Xt+1,Yt+1) is the centroid location of the moving area image in the second capture time, and TH1 is a predetermined value; and a comparing unit coupled to the location analysis unit and comparing the first analyzed result with a first predetermined threshold.

35. The flame detecting device as claimed in claim 34, wherein the flame detecting device further comprises:

a first analyzing unit coupled to the image capturing unit and determining whether the moving area image exists in the plurality of images;

a second analyzing unit coupled to the image capturing unit and analyzing a color model of a moving area image in the plurality of images to generate a second analyzed result, wherein the color model applies at least one of a three-dimensional RGB Gaussian mixture model and a three-dimensional YUV Gaussian mixture model;

a third analyzing unit coupled to the image capturing unit and analyzing a flickering frequency of a moving area image in the plurality of images to generate a third analyzed result;

an area analysis unit coupled to the image capturing unit for analyzing an area variation of the moving area image to generate a fourth analyzed result, which is compared with a second predetermined threshold;

a database coupled to the comparing unit and storing the reference flame features; and an alarming unit coupled to the comparing unit for generating an alarm signal when the moving area image is determined as a flame image, wherein the comparing unit is coupled to each of the analyzing units and compares the analyzed results to a feature of a reference flame.

36. The flame detecting method as claimed in claim 34, wherein TH1 is 80 pixels when a size of the plurality of images is 320×240 pixels.

37. A flame detecting device, comprising:

an image capturing unit capturing a plurality of images, wherein the plurality of images are recorded images of the monitored area at different time and comprise a first image in a first capture time and a second image in a second capture time;

an area analysis unit coupled to the image capturing unit for analyzing an area variation of the moving area image to generate a first analyzed result, wherein the area analysis unit determines a extent an area of the moving area image varies with time by using an object tracking algorithm, and the moving area image is determined as not a flame image when the extent exceeds a predetermined range, which is defined as:

$$(1/3)At<At+1<3At$$

wherein At is the area of the moving area image in the first capture time, and At+1 is the area of the moving area image in the second capture time; and a comparing unit coupled to the area analysis unit and comparing the first analyzed result with a first predetermined threshold.

38. The flame detecting device as claimed in claim 37, further comprising:

a first analyzing unit coupled to the image capturing unit and determining whether the moving area image exists in the plurality of images;

a second analyzing unit coupled to the image capturing unit and analyzing a color model of a moving area image in the plurality of images to generate a second analyzed result, wherein the color model applies at least one of a three-dimensional RGB Gaussian mixture model and a three-dimensional YUV Gaussian mixture model;

a third analyzing unit coupled to the image capturing unit and analyzing a flickering frequency of a moving area image in the plurality of images to generate a third analyzed result;

a location analysis unit coupled to the image capturing unit for analyzing a location variation of the moving area image to generate a fourth analyzed result, which is compared with a second predetermined threshold;

a database coupled to the comparing unit and storing the reference flame features; and an alarming unit coupled to the comparing unit for generating an alarm signal when the moving area image is determined as a flame image, wherein the comparing unit is coupled to each of the analyzing units and compares the analyzed results to a feature of a reference flame.

* * * * *